US007918530B2

(12) United States Patent
Kanfoush et al.

(10) Patent No.: US 7,918,530 B2
(45) Date of Patent: Apr. 5, 2011

(54) APPARATUS AND METHOD FOR CLEANING AN INKJET PRINTHEAD

(75) Inventors: Dan E. Kanfoush, Niagara Falls, NY (US); Kevin J. Hook, Grand Island, NY (US); Anthony V. Moscato, North Tonawanda, NY (US); Theodore Cyman, Jr., Grand Island, NY (US); Lawrence A. Pilon, Hamburg, NY (US)

(73) Assignee: RR Donnelley, Chicago, IL (US)

( * ) Notice: Subject to any disclaimer, the term of this patent is extended or adjusted under 35 U.S.C. 154(b) by 1077 days.

(21) Appl. No.: 11/701,703

(22) Filed: Feb. 2, 2007

(65) Prior Publication Data

US 2007/0188542 A1 Aug. 16, 2007

Related U.S. Application Data

(60) Provisional application No. 60/765,353, filed on Feb. 3, 2006.

(51) Int. Cl.
*B41J 2/165* (2006.01)
*B41J 2/015* (2006.01)

(52) U.S. Cl. ..... 347/22; 347/21

(58) Field of Classification Search ..... 347/21, 347/22, 28, 27, 35, 41, 86, 84, 97; 134/104.2
See application file for complete search history.

(56) References Cited

U.S. PATENT DOCUMENTS

| | | | |
|---|---|---|---|
| 3,560,641 | A | 2/1971 | Taylor et al. |
| 3,647,138 | A | 3/1972 | Houser |
| 3,723,645 | A | 3/1973 | Takami et al. |
| 3,747,120 | A | 7/1973 | Stemme |
| 3,891,121 | A | 6/1975 | Stoneburner |
| 3,974,508 | A | 8/1976 | Blumenthal |
| 4,042,937 | A | 8/1977 | Perry et al. |
| 4,050,078 | A | 9/1977 | Isayama et al. |
| 4,051,538 | A | 9/1977 | Fox et al. |
| 4,063,254 | A | 12/1977 | Fox et al. |
| 4,067,020 | A | 1/1978 | Arway |
| 4,116,626 | A | 9/1978 | Varner |
| 4,126,868 | A | 11/1978 | Kirner |
| 4,184,167 | A | 1/1980 | Vandervalk |

(Continued)

FOREIGN PATENT DOCUMENTS

| | | |
|---|---|---|
| EP | 585 901 | 3/1994 |

(Continued)

OTHER PUBLICATIONS

International Search Report and Written Opinion, PCT/US2007/03239, dated Feb. 20, 2008.

(Continued)

*Primary Examiner* — Stephen D Meier
*Assistant Examiner* — Carlos A Martinez, Jr.
(74) *Attorney, Agent, or Firm* — McCracken & Frank LLP

(57) ABSTRACT

A cleaning system for an inkjet printhead comprises an inkjet printhead having an inkjet nozzle array associated therewith. The inkjet printhead is in fluid communication with a first source of a first pressurized fluid. A fluid nozzle associated with the inkjet printhead is in fluid communication with a second source of a second pressurized fluid. The cleaning system further comprises a collection plate. Ink is forcibly ejected from the inkjet printhead by the first source of the first pressurized fluid. A stream of the second pressurized fluid is guided by the fluid nozzle across a surface of the inkjet printhead to direct ink ejected from the inkjet printhead onto the collection plate.

73 Claims, 6 Drawing Sheets

U.S. PATENT DOCUMENTS 4,208,666 A 6/1980 Paranjpe
4,222,080 A 9/1980 Frazier
4,240,082 A 12/1980 Yu
4,250,512 A 2/1981 Kattner et al.
4,260,996 A 4/1981 Wittwer
4,296,418 A 10/1981 Yamazaki et al.
4,317,124 A 2/1982 Shirato et al.
4,330,787 A 5/1982 Sato et al.
4,362,572 A 12/1982 Wallace
4,403,229 A 9/1983 Barteck
4,410,897 A 10/1983 Moriguchi et al.
4,432,005 A 2/1984 Duffield et al.
4,494,124 A 1/1985 Piatt et al.
4,520,366 A 5/1985 Cragin, Jr.
4,528,996 A * 7/1985 Jones ..... 134/104.2
4,542,389 A 9/1985 Allen
4,571,600 A 2/1986 Hara
4,593,295 A 6/1986 Matsufuji et al.
4,598,303 A 7/1986 Peekema et al.
4,598,329 A 7/1986 Nelson
4,607,266 A 8/1986 DeBonte
4,623,897 A 11/1986 Brown et al.
4,628,329 A 12/1986 Regnault
4,706,099 A 11/1987 Suzuki
4,812,859 A 3/1989 Chan et al.
4,814,794 A * 3/1989 Sato ..... 347/28
4,825,229 A 4/1989 Matsumoto et al.
4,835,544 A 5/1989 Winterburn
4,881,132 A 11/1989 Lajos
5,087,805 A 2/1992 Silverschutz et al.
5,126,752 A 6/1992 Weinberg
5,126,766 A 6/1992 Terasawa et al.
5,182,578 A 1/1993 Goepel et al.
5,210,550 A 5/1993 Fisher et al.
5,369,429 A 11/1994 Erickson
5,382,969 A 1/1995 Mochizuki et al.
5,428,375 A 6/1995 Simon et al.
5,446,486 A 8/1995 Reis
5,504,510 A 4/1996 Miyakawa
5,543,827 A * 8/1996 VanSteenkiste et al. ..... 347/27
5,598,198 A 1/1997 Taylor et al.
5,646,666 A 7/1997 Cowger et al.
5,670,995 A 9/1997 Kupcho et al.
5,765,481 A 6/1998 Tortora et al.
5,784,077 A 7/1998 Silverbrook
5,793,389 A 8/1998 Mitchell
5,796,411 A 8/1998 Cyman et al.
5,797,305 A 8/1998 Harrod et al.
5,812,151 A 9/1998 Kishine et al.
5,825,380 A 10/1998 Ichizawa et al.
5,877,788 A 3/1999 Haan et al.
5,877,793 A 3/1999 Erickson
5,903,293 A 5/1999 Nikkels et al.
5,923,347 A 7/1999 Wade
5,929,877 A 7/1999 Hetzer et al.
5,929,878 A 7/1999 Pelletier
5,949,438 A 9/1999 Cyman et al.
5,992,990 A 11/1999 Childers et al.
6,000,792 A 12/1999 Koizumi et al.
6,003,988 A 12/1999 McCann et al.
6,023,594 A 2/2000 Okiyama et al.
6,030,074 A 2/2000 Barinaga
6,033,061 A 3/2000 Niedermeyer et al.
6,089,693 A 7/2000 Drake et al.
6,120,142 A 9/2000 Eltgen et al.
6,164,768 A 12/2000 Murphy et al.
6,224,198 B1 5/2001 Cook et al.
6,234,597 B1 5/2001 Suzuki et al.
6,234,617 B1 5/2001 Niedermeyer et al.
6,267,518 B1 7/2001 Abe
6,273,103 B1 8/2001 Enz et al.
6,335,978 B1 1/2002 Moscato et al.
6,344,904 B1 2/2002 Mercer
6,347,858 B1 2/2002 Faisst, Jr. et al.
6,357,854 B1 3/2002 Igval et al.
6,364,451 B1 4/2002 Silverbrook
6,402,293 B1 6/2002 Sawicki
6,428,156 B1 8/2002 Waller et al.
6,435,637 B1 8/2002 Lyman
6,460,441 B1 10/2002 Harrod
6,530,644 B2 3/2003 Premnath et al.
6,547,370 B2 4/2003 Mantell et al.
6,575,554 B2 6/2003 Yoshinaga
6,575,556 B1 * 6/2003 Eremity et al. ..... 347/28
6,601,951 B2 8/2003 Kuwabara et al.
6,660,103 B1 12/2003 Johnston et al.
6,663,220 B2 12/2003 Suzuki et al.
6,663,304 B2 12/2003 Vives et al.
6,669,327 B1 12/2003 Harper
6,672,702 B2 1/2004 Sadasivan et al.
6,679,590 B2 1/2004 Enz
6,688,721 B1 2/2004 Serra
6,733,106 B1 5/2004 Leemhuis
6,802,588 B2 10/2004 Garbacz et al.
6,808,246 B2 10/2004 Long
6,811,249 B2 11/2004 DeVries et al.
6,830,315 B2 12/2004 Silverbrook et al.
6,843,553 B2 1/2005 Ishii et al.
6,869,160 B2 3/2005 West et al.
6,880,912 B2 4/2005 Klausbruckner et al.
6,890,053 B2 5/2005 Myhill et al.
6,908,165 B2 6/2005 Pinard
6,916,132 B2 7/2005 Otsuka et al.
6,935,729 B2 8/2005 De Marco et al.
6,991,311 B2 1/2006 Su et al.
7,070,250 B2 7/2006 Lester et al.
7,103,306 B2 9/2006 Shimizubata
7,118,189 B2 10/2006 Kuester et al.
7,178,900 B2 2/2007 Blouin et al.
7,212,319 B2 5/2007 Mercer
7,222,955 B2 5/2007 Ohashi et al.
7,384,119 B2 6/2008 Karppinen et al.
7,401,888 B2 7/2008 Karppinen et al.
2001/0050697 A1 * 12/2001 Jackson ..... 347/35
2003/0016267 A1 * 1/2003 Green ..... 347/41
2004/0207708 A1 10/2004 Ohashi et al.
2005/0099469 A1 5/2005 Encrenaz et al.
2005/0157115 A1 * 7/2005 Silverbrook ..... 347/86
2005/0219589 A1 10/2005 Mercer
2005/0253886 A1 11/2005 Nakajima et al.
2005/0264620 A1 * 12/2005 Kuester et al. ..... 347/84
2006/0274130 A1 12/2006 Self et al.
2007/0195144 A1 * 8/2007 McNestry ..... 347/97

FOREIGN PATENT DOCUMENTS

EP 0 749 836 12/1996
GB 2 280 149 A 1/1995
JP 62 218139 A 9/1987
JP 10-324038 A 12/1998
WO WO 96/35584 11/1996

OTHER PUBLICATIONS

International Preliminary Report on Patentability, dated Jan. 5, 2010, Appl. No. PCT/US2008/008114.
International Preliminary Report on Patentability, dated Aug. 14, 2008, Appl. No. PCT/US07/03239.
International Search Report and Written Opinion in Appl. No. PCT/US2008/008114 dated Sep. 8, 2008.
Supplementary European Search Report, dated Nov. 14, 2008, Appl. No. EP 07763393.

* cited by examiner

APPARATUS AND METHOD FOR CLEANING AN INKJET PRINTHEAD

CROSS REFERENCE TO RELATED APPLICATIONS

This application claims the benefit of U.S. Provisional Application Ser. No. 60/765,353, filed Feb. 3, 2006, and incorporated herein by reference in its entirety.

REFERENCE REGARDING FEDERALLY SPONSORED RESEARCH OR DEVELOPMENT

Not applicable

SEQUENTIAL LISTING

Not applicable

BACKGROUND OF THE INVENTION

1. Field of the Invention

The present invention relates generally to inkjet printing systems and more particularly to an apparatus and method for cleaning inkjet printing systems.

2. Description of the Background of the Invention

Inkjet printing systems include one or more inkjet printheads, each inkjet printhead including an inkjet nozzle array. Inkjet printing systems are used extensively for high volume printing applications requiring high speed and precision. Dried ink, dust, paper fibers, and other debris can collect on the printhead surfaces, clogging inkjet nozzles and preventing proper ejection of ink therefrom. Therefore, keeping the inkjet nozzles free of ink and debris is crucial to the efficient operation of such systems.

Inkjet printheads are cleaned using a variety of methods including scraping, vacuuming, flushing with a fluid, or other methods. In one such cleaning system, ink droplets, dust, and debris are scraped off a printhead surface by an edge portion of a cleaning blade that contacts the surface. Another such cleaning system has a vacuum orifice that is positioned over a printhead nozzle array and an area of the printhead surface around the nozzle array. A gap between the vacuum orifice and the printhead surface provides sufficient space for the passage of documents yet enables the vacuum to clean both the printhead surface and the printhead nozzle array. Yet another cleaning system utilizes a stream of air angled toward a surface of a document moving under a printhead. The stream of air is directed toward the printhead, thereby preventing dust particles entrained in air near the document surface from collecting on the printhead.

One of the other methods for cleaning an inkjet printhead includes an ultrasonic liquid wiper. A cleaning nozzle is confrontingly aligned across a small space from a printhead nozzle array and a meniscus of cleaning solution is allowed to bulge out of the cleaning nozzle to make contact with the printhead nozzle array surface. The cleaning solution is then ultrasonically excited by a piezoelectric material, thereby providing a high frequency liquid wiper to clean the printhead nozzle array. A vacuum nozzle then removes the cleaning solution and any ink dissolved therein.

Still other printhead cleaning systems include an adsorbent material such as a thread that is movably positioned across a printhead surface proximate to a printhead nozzle array. Dust and other debris are caught on the thread instead of collecting on the printhead surface. A continuous supply of clean thread from a spool allows dust and debris to be continuously captured.

Some printhead cleaning systems utilize both scraping and vacuum. One such system has a suction unit capable of applying suction to several nozzles of a nozzle array, and that also translates across a face of a printhead. The suction unit includes a resilient blade on a side of the unit in the direction of motion allowing the unit to scrape the surface of the printhead and also apply suction to the nozzles across an entire printhead surface.

Other printhead cleaning systems include a nozzle array plate positioned between a printhead nozzle array and a moving paper web. The plate has a narrow slit proximate to the printhead nozzle array allowing ink to be sprayed through the plate onto the paper web. To prevent ink mist from contaminating the printhead nozzle array surface, a fluid is flushed across the surface in a small gap between the plate and the surface. The fluid is introduced above the printhead nozzle array, flows downwardly over the nozzle array and then is vacuumed by a suction opening below the narrow slit.

Another printhead cleaning system includes a translating solvent delivering wiper and vacuum cleaning block. The cleaning block has a solvent delivering passageway on a side of the unit in the direction of motion that delivers solvent to the printhead surface proximate to an edge of a blade portion that makes scraping contact with the printhead surface. A vacuum canopy opposite the blade portion vacuums the solvent and debris loosened by the blade portion. In addition, a vacuum hood capable of sealingly engaging the printhead surface is positioned on a side of the unit opposite the direction of motion. The vacuum hood vacuums particulate matter from the printhead surface and from within nozzles of the printhead nozzle array.

Yet another printhead cleaning system dribbles small ink droplets out of nozzles. Strands of material capable of attracting and absorbing ink mist, such as ordinary string, are positioned in contact with or adjacent to the printhead surface and proximate to the nozzles. The dribbled ink droplets keep the nozzles clear of ink, and are absorbed and carried away on the strands of string.

SUMMARY OF THE INVENTION

According to one aspect of the invention, a cleaning system for an inkjet printhead comprises an inkjet printhead having an inkjet nozzle array associated therewith, the inkjet printhead being in fluid communication with a first source of a first pressurized fluid. A fluid nozzle associated with the inkjet printhead is in fluid communication with a second source of a second pressurized fluid. The cleaning system further comprises a collection plate. Ink is forcibly ejected from the inkjet printhead by the first source of the first pressurized fluid. A stream of the second pressurized fluid is guided by the fluid nozzle across a surface of the inkjet printhead to direct ink ejected from the inkjet printhead onto the collection plate.

According to another aspect of the invention, a method for cleaning an inkjet printhead comprises forcibly ejecting ink from an inkjet printhead through the inkjet nozzle array associated therewith by applying a first pressurized fluid to increase the internal pressure of the inkjet printhead. The method further comprises guiding a stream of a second pressurized fluid across a surface of the inkjet printhead to direct ink ejected from the inkjet printhead onto a collection plate, and collecting the ink ejected from the inkjet printhead on the collection plate.

According to still another aspect of the invention, a cleaning system for an inkjet printhead comprises an inkjet printhead having a port and an inkjet nozzle array associated therewith. A first source of a first pressurized fluid is connected to the port by a fluid connector, and a fluid nozzle associated with the inkjet printhead is in fluid communication with a second source of a second pressurized fluid. The cleaning system further comprises a porous collection plate and a controller. Ink is forcibly ejected from the inkjet printhead by the first source of the first pressurized fluid. A stream of the second pressurized fluid is guided by the fluid nozzle across a surface of the inkjet printhead to direct ink ejected from the inkjet printhead onto the collection plate. Debris collected near a nozzle surface is removed by entrainment in a stream of forcibly ejected ink and the stream of the second pressurized fluid. The controller controls the timing of when ink is forcibly ejected from the inkjet printhead and when the stream of the second pressurized fluid is guided across the surface of the inkjet printhead.

According to a further aspect of the invention, a cleaning system for an inkjet printhead comprises an inkjet printhead mount having an ink inlet port and an ink outlet port associated therewith. A first source of ink is in fluid communication with the ink inlet port. A second source of ink is in fluid communication with the ink inlet port. A supply of cleaning fluid is in fluid communication with the ink inlet port. A supply of pressurized air is in fluid communication with the ink inlet port. A waste collection system is in fluid communication with the ink outlet port. Cleaning fluid is applied to the ink inlet port to flush ink from the first source of ink out of the printhead mount through the ink outlet port. The cleaning fluid and ink exiting the ink outlet port are collected in a waste collection system, and ink from the second source of ink is applied to the ink inlet port.

According to yet another aspect of the invention, a cleaning system for an inkjet printhead comprises an inkjet printhead having an inkjet nozzle array associated therewith. The inkjet printhead is in fluid communication with a first source of a first pressurized fluid. A fluid nozzle associated with the inkjet printhead is in fluid communication with a second source of a second pressurized fluid. A stream of the second pressurized fluid is guided by the fluid nozzle across a surface of the inkjet printhead to control and maintain the temperature and relative humidity at the surface of the inkjet printhead, and to control and maintain the temperature, relative humidity, and gas density in a space proximate to the surface of the inkjet printhead.

Other aspects and advantages of the present invention will become apparent upon consideration of the following detailed description.

DETAILED DESCRIPTION

Figure 1:
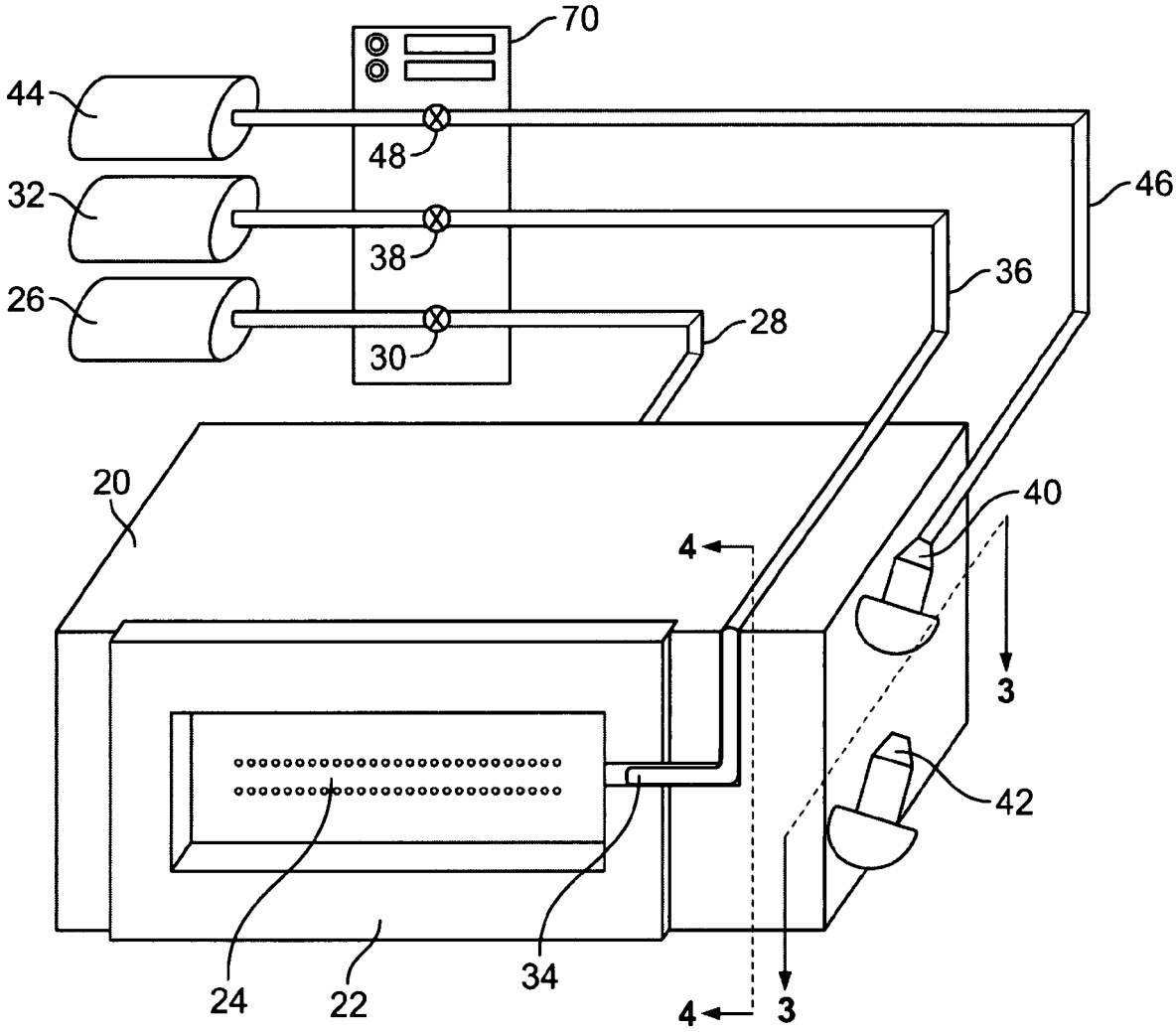
FIG. 1 is a front isometric view of an inkjet printhead, shown in schematic relation to a controller, two sources of pressurized fluid, and a source of ink, according to one aspect of the present invention.

A complete inkjet printing system can vary in complexity from a simple system comprising a single inkjet printhead to a complex system comprising multiple arrays of a plurality of inkjet printheads. Referring to FIG. 1, a single inkjet printhead 20 is shown. A collection plate 22 extends from a surface of the inkjet printhead 20. The collection plate surrounds an inkjet nozzle array 24. In operation, ink is controllably ejected from the nozzles of the inkjet nozzle array 24 onto a web of paper moving past the inkjet printhead 20.

A first source 26 of a first pressurized fluid is connected to the inkjet printhead 20 by a first fluid connector 28 that is connected through a first solenoid valve 30. A second source 32 of a second pressurized fluid is connected to a fluid nozzle 34 by a second fluid connector 36 that is connected through a second solenoid valve 38. An ink inlet port 40 and an ink outlet port 42 extend from a side of the inkjet printhead 20. A first source of ink 44 is connected to the ink inlet port 40 by a third fluid connector 46 that is connected through a third solenoid valve 48.

Figure 2:
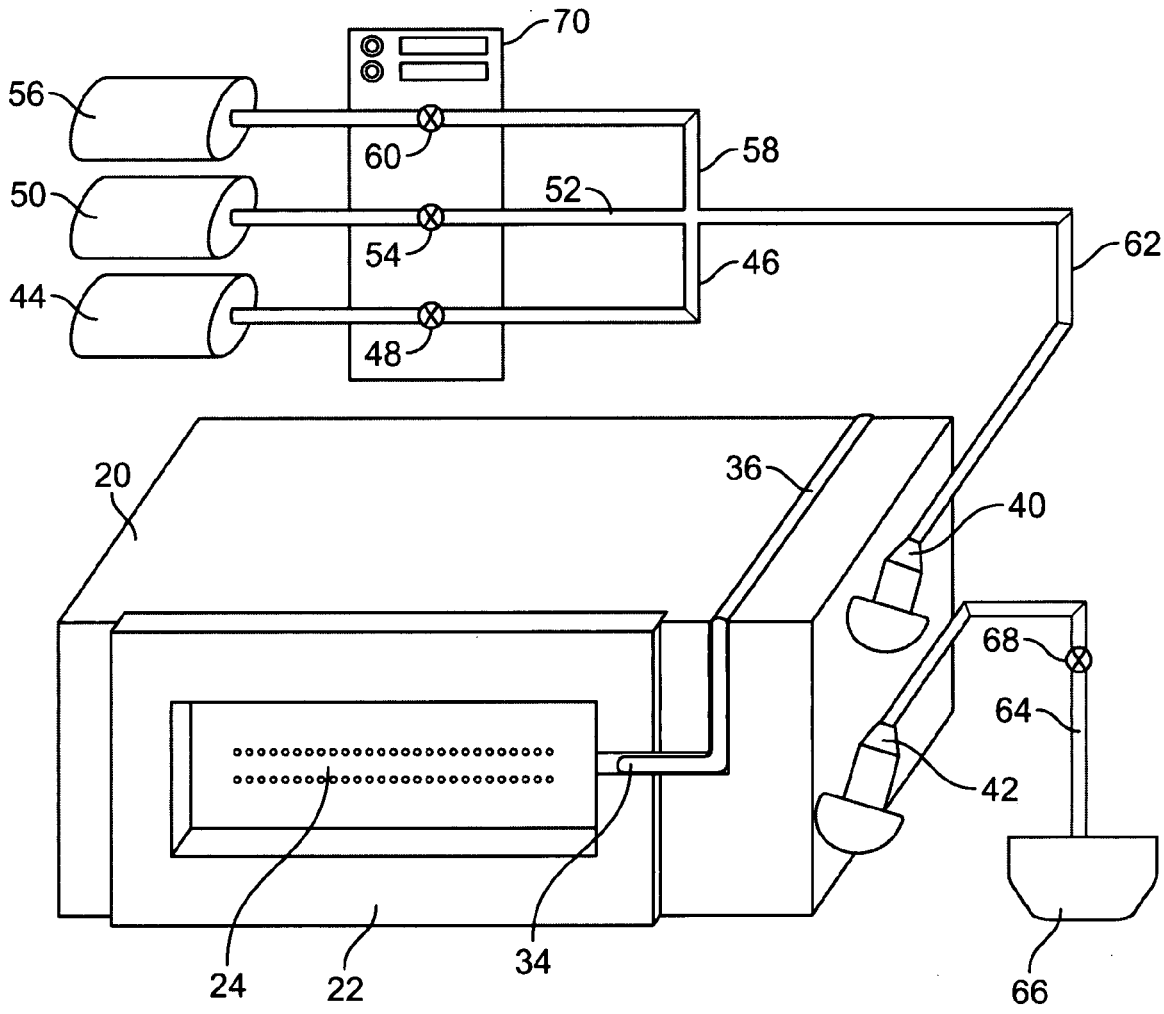
FIG. 2 is a front isometric view of an inkjet printhead, shown in schematic relation to a controller, an optional source of cleaning fluid, and a waste collection system according to one aspect of the present invention.

Referring to FIG. 2, a second source of ink 50 is connected to a fourth fluid connector 52 that is connected through a fourth solenoid valve 54. The second source of ink 50 may be of a different color than the first source of ink 44. In fact, any number of additional sources of ink beyond the second source of ink 50 may be connected to the system, and each of the additional sources of ink may be a unique color. Each additional source of ink may be connected to the system by an additional fluid connector through an individually controlled solenoid valve.

An optional source 56 of cleaning fluid or pressurized air is connected to a fifth fluid connector 58 that is connected through a fifth solenoid valve 60. Additional sources of cleaning fluids or pressurized air may also be connected to the system in a manner similar to the optional source 56 of cleaning fluid or pressurized air. Each of these additional sources of cleaning fluids or pressurized air may be connected to the system by an additional fluid connector through an individually controlled solenoid valve. Outlet connections from the third, fourth, and fifth solenoid valves, 48, 54, and 60, as well as from solenoid valves corresponding to any additional sources of ink, cleaning fluid, or pressurized air are manifolded into a sixth fluid connector 62 that connects to the ink inlet port 40. A seventh fluid connector 64 connects the ink outlet port 42 to a waste collection system 66 through an outlet solenoid valve 68. Each of the fluid connectors 28, 36, 46, 52, 58, 62, and 64 may be flexible tubes or pipes or any sort of hose capable of carrying a fluid medium as is well known in the art.

A controller 70 is electrically connected to and controls each of the solenoid valves 30, 38, 48, 54, 60, and 68. The function and purpose of the controller 70 will be described in more detail below after a further description of the inkjet printhead 20 structure.

Figure 3:
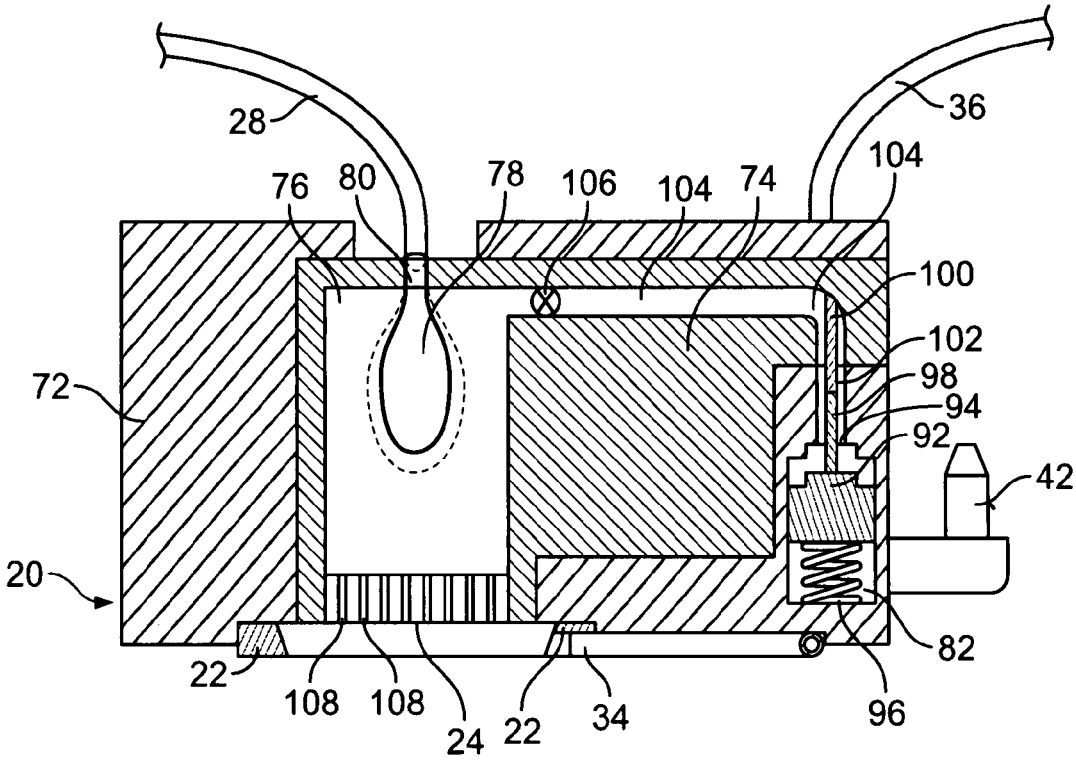
FIG. 3 is a schematic cross-sectional view of an inkjet printhead looking along line 3-3 of FIG. 1.

Referring to FIG. 3, the inkjet printhead 20 comprises a printhead mount 72 and a printhead cartridge 74 both schematically shown in cross-section. The printhead cartridge 74 fits into the printhead mount 72 and is held in place by a locking clamp not shown. An ink cavity 76 is defined by the body of the printhead cartridge 74. An expandable bladder 78 is disposed within the ink cavity 76 and spans a port 80 through a surface of the printhead cartridge 74. The first fluid connector 28 connects to the port 80 such that an interior of the expandable bladder 78 is in hydraulic communication with the first source 26 of the first pressurized fluid.

Figure 4:
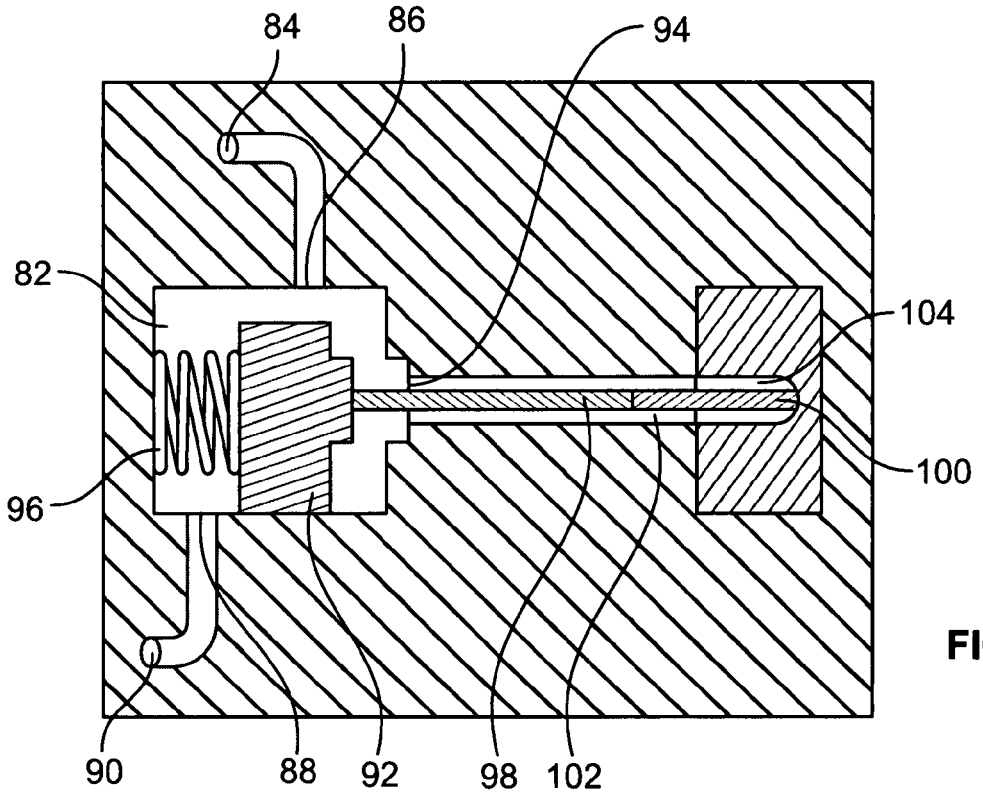
FIG. 4 is a schematic cross-sectional view of an inkjet printhead looking along line 4-4 of FIG. 1.

Referring to FIGS. 1 and 2, ink supplied from the first source of ink 44 enters the printhead at the ink inlet port 40. The ink inlet port 40 is in fluid communication with a valve cavity 82 visible in FIGS. 3 and 4 through an inlet channel 84 and an inlet opening 86. The valve cavity 82 is in fluid communication with the ink outlet port 42 through a first outlet opening 88 and an outlet channel 90. A plunger 92 within the valve cavity 82 is forced into sealing contact with a second outlet opening 94 by a spring 96.

A plunger pin 98 extends from a side of the plunger 92 opposite the spring 96. When a printhead cartridge 74 is installed in the printhead mount 72, a cartridge pin 100 on the printhead cartridge 74 forces the plunger pin 98 toward the plunger 92. This force on the plunger pin 98 compresses the spring 96 and causes the plunger 92 to move away from the second outlet opening 94. With a printhead cartridge 74 properly installed, the second outlet opening 94 is in fluid communication with the ink inlet port 40. During normal operation, outlet solenoid valve 68 disposed in seventh fluid connector 64 is closed. Ink supplied to the ink inlet port 40 with a printhead cartridge 74 installed can flow into a valve channel 102 that is in fluid communication with an internal ink channel 104 within the printhead cartridge 74. The internal ink channel 104 connects to the ink cavity 76 through an ink supply valve 106 that is actuated in response to the state of the expandable bladder 78.

Figure 5:
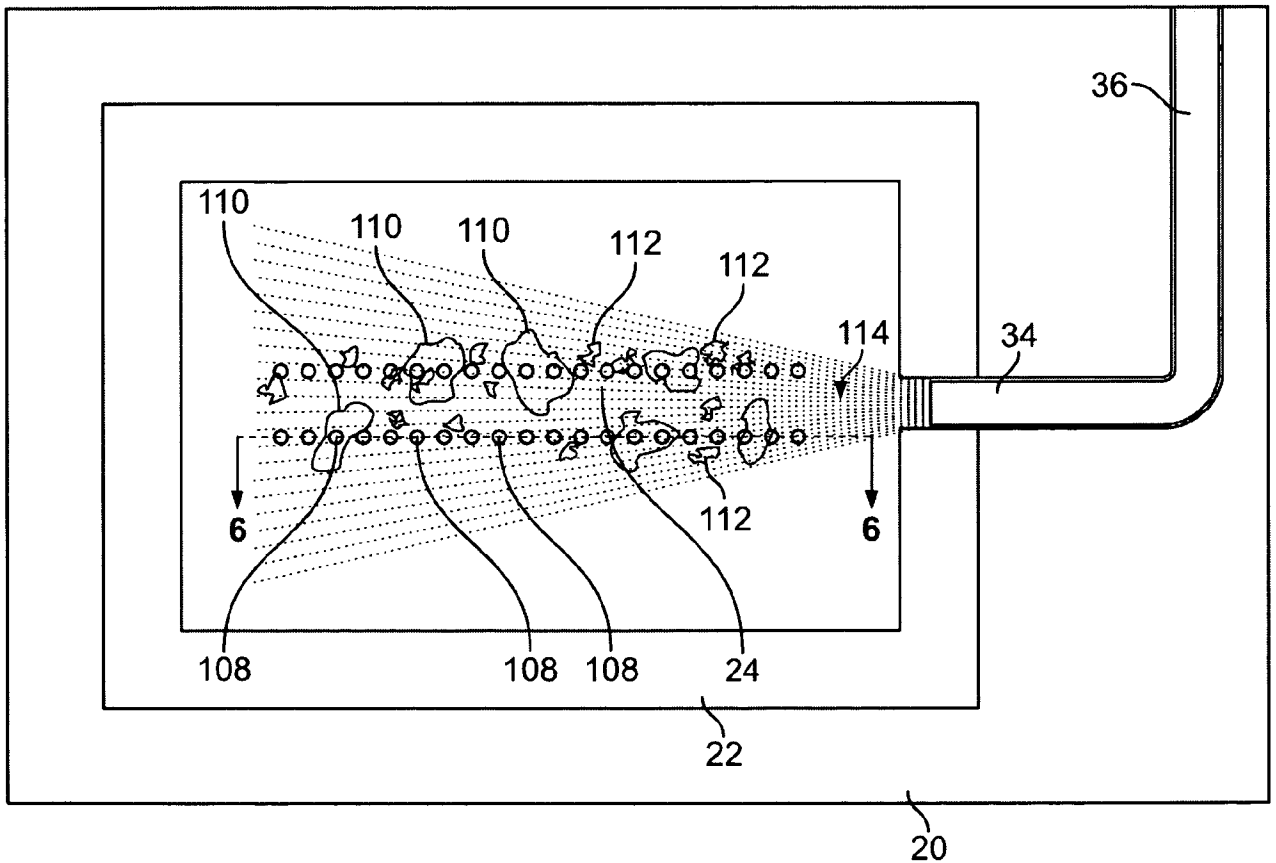
FIG. 5 is a front view of the inkjet printhead, schematically showing an inkjet nozzle array and a fluid nozzle.

In normal operation, ink is controllably ejected through nozzles 108 of the inkjet nozzle array 24. As represented in FIG. 5, during the normal course of operation, dried ink 110 and other debris 112 may collect on a surface of the inkjet nozzle array 24, as well as inside nozzles 108 of the inkjet nozzle array 24. A view across the surface of a contaminated inkjet nozzle array 24, along section line 6-6, can be seen in FIG. 6. The dried ink 110 and other debris 112 can clog the nozzles 108 in the inkjet nozzle array 24. Nozzles 108 that are blocked or partially clogged will not function correctly thereby preventing the inkjet printing system from correctly operating.

In a first embodiment of the invention, the inkjet printhead 20 is cleaned by two operations as will now be described in detail. These operations may occur synchronously or even simultaneously. A first operation is forcibly ejecting ink from the inkjet printhead 20 through the inkjet nozzle array 24. This forcible ejection of ink cleans the nozzles 108 that may be blocked or partially clogged by forcibly ejecting the blockage. The forcible ejection of ink also entrains debris 112 from the surface of the inkjet nozzle array 24.

Ink is forcibly ejected from the inkjet printhead 20 by a temporary increase in internal pressure of ink within the ink cavity 76. This temporary pressure increase within the ink cavity 76 is achieved by causing the expandable bladder 78 to temporarily expand within the ink cavity 76 by application of the first pressurized fluid. The controller 70 controls operation of the first solenoid valve 30, and therefore controls the amount of first pressurized fluid released, and also the duration of the release. The first pressurized fluid typically has sufficient pressure to force the ink through the inkjet nozzle array 24. The first pressurized fluid can have a pressure in a range of 3-10 psig (21-69 kpag), although fluids with other pressures can be used. The first pressurized fluid is preferably air however water, oil, or any other well characterized fluid medium may also be used.

Ink within the internal ink channel 104 is maintained at a sufficient pressure such that a short duration increase in pressure within the ink cavity 76 will force ink through the inkjet nozzle array 24 and not back through the internal ink channel 104. The ink supply valve 106 is actuated in response to the state of expansion of the expandable bladder 78. Expansion of the expandable bladder 78 opens the ink supply valve 106, and collapse of the bladder 78 closes the valve 106. Expansion of the expandable bladder 78 also reduces the volume of the ink cavity 76 and thereby increases the pressure of the ink therein. Therefore, a short duration increase in pressure of the first pressurized fluid that temporarily expands the expandable bladder 78 causes a pressure increase in the ink cavity 76 by opening the ink supply valve 106 and also by reducing the volume within the ink cavity 76. Such a short duration increase in pressure of the first pressurized fluid can cause a sufficient increase in pressure within the ink cavity 76 to force ink out of the inkjet printhead 20 through nozzles 108 of the inkjet nozzle array 24. In some other arrangements, the printhead 20 may not have an expandable bladder 78, and the first pressurized fluid will directly act on the ink within the printhead 20.

Figure 6:
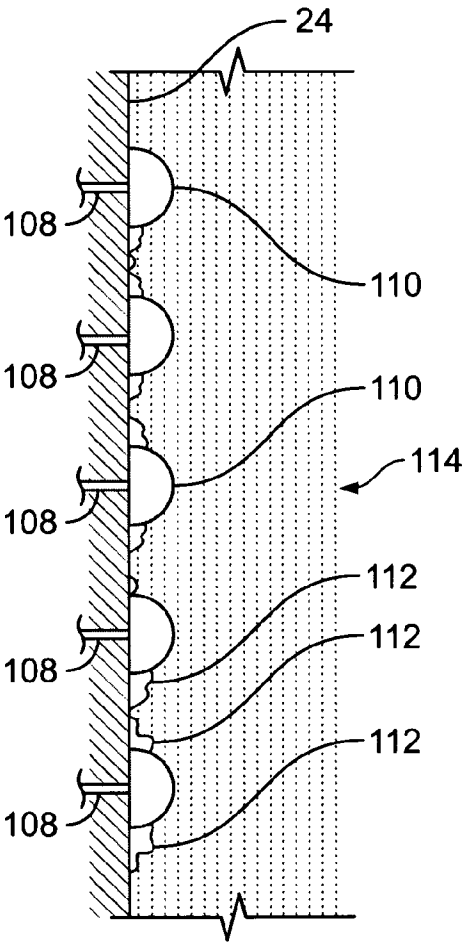
FIG. 6 is a schematic cross-sectional view of an inkjet nozzle array looking along line 6-6 of FIG. 5.

A second operation is directing a stream 114 of the second pressurized fluid across a surface of the inkjet printhead 20, as schematically depicted in FIGS. 5 and 6. The fluid nozzle 34 is disposed in a channel extending through a side of the collection plate 22. In some arrangements, the collection plate 22 has only three sides instead of four sides as shown in FIG. 5, the missing side of the collection plate 22 being the side having the channel extending therethrough. Referring to FIG. 6, the stream 114 of the second pressurized fluid is guided by the fluid nozzle 34, exiting the fluid nozzle 34 in a path that is substantially parallel to the surface. The second pressurized fluid expands and washes across the surface of the inkjet nozzle array 24. Dried ink 110 and debris 112 are loosened by the force and possibly the chemical composition of the stream 114, and the loosened ink 110 and debris 112 are then entrained by the stream 114 and removed from the surface of the inkjet nozzle array 24.

The stream 114 also impinges upon and entrains streams of forcibly ejected ink emerging from nozzles 108. The matter entrained by the stream 114 may therefore comprise the forcibly ejected ink, the dried ink 110 and debris 112 from the inkjet nozzle array 24, and the dried ink 110 and debris 112 from inside the nozzles 108. The stream 114 directs all the matter entrained onto the collection plate 22.

The collection plate 22 collects the entrained matter and thereby prevents further contamination of the inkjet printhead 20 surface and surrounding surfaces. The collection plate 22 is made of a porous material that may be plastic, metal, ceramic, or some other porous material. After one or more cleaning cycles the collection plate 22 may become fouled with entrained matter. A fouled collection plate 22 can be removed and replaced with a clean collection plate 22.

The controller 70 controls operation of the second solenoid valve 38, and therefore controls the amount of second pressurized fluid released, and also the duration of the release. The second pressurized fluid typically has a pressure higher than the first pressurized fluid and sufficiently high to create a stream 114 of second pressurized fluid that washes across the surface of the inkjet nozzle array 24. Although any high pressure can be used, a pressure in a range of 90-100 psig (620-689 kPag) has been found to be acceptable. Because the stream 114 of the second pressurized fluid not only entrains loosened matter but also impinges directly upon the inkjet nozzle array 24 surface, it is advantageous to include a solvent or humectant in the second pressurized fluid. Accordingly, the second pressurized fluid may comprise air, water, solvent, water-displacing agent, or humectant, or combinations of any of these or any other chemical solution or ingredient that may be advantageous to cleaning or maintaining the inkjet nozzle array 24 surface.

In another embodiment of the invention, the nozzle array 24 and a region of space proximate the nozzle array 24 can be maintained in a desired condition by selective use of the second pressurized fluid guided by the fluid nozzle 34. The temperature and relative humidity at the surface and in the space proximate the nozzle array 24 can be controlled. To keep the surface moist, the second pressurized fluid could be a mixture of air and water vapor. Although any relative humidity can be achieved, a typical desired relative humidity proximate the nozzle array is 60%, and this can be achieved for example by a second pressurized fluid comprised of air bubbled through water. The temperature of the surface and space proximate the nozzle array 24 can also be controlled by warmer or cooler streams of second pressurized fluid. The density of gas in the space proximate the surface of the nozzle array 24 can also be controlled by using a lower molecular weight gas such as helium or a higher molecular weight gas such as argon, instead of air. A change in gas density changes aerodynamic forces on droplets of ink flying through the gas, thereby affecting the path of travel of the droplets.

The controller 70 can synchronize the release of the first and second pressurized fluids. The release may be simultaneous or may also be offset by a brief time interval. The controller 70 also controls the duration of release of each of the first and second pressurized fluids. In one embodiment, the first and second pressurized fluids are released simultaneously. The first pressurized fluid is typically released for a relatively short period of time such as about 0.1 seconds. The second pressurized fluid is typically released for a somewhat longer period, about 3 seconds. Alternatively, either the first or second pressurized fluid can be released initially followed by release of the other fluid. The cleaning operations described are executed during a period when the inkjet printhead 20 is not in normal operation.

Figure 7:
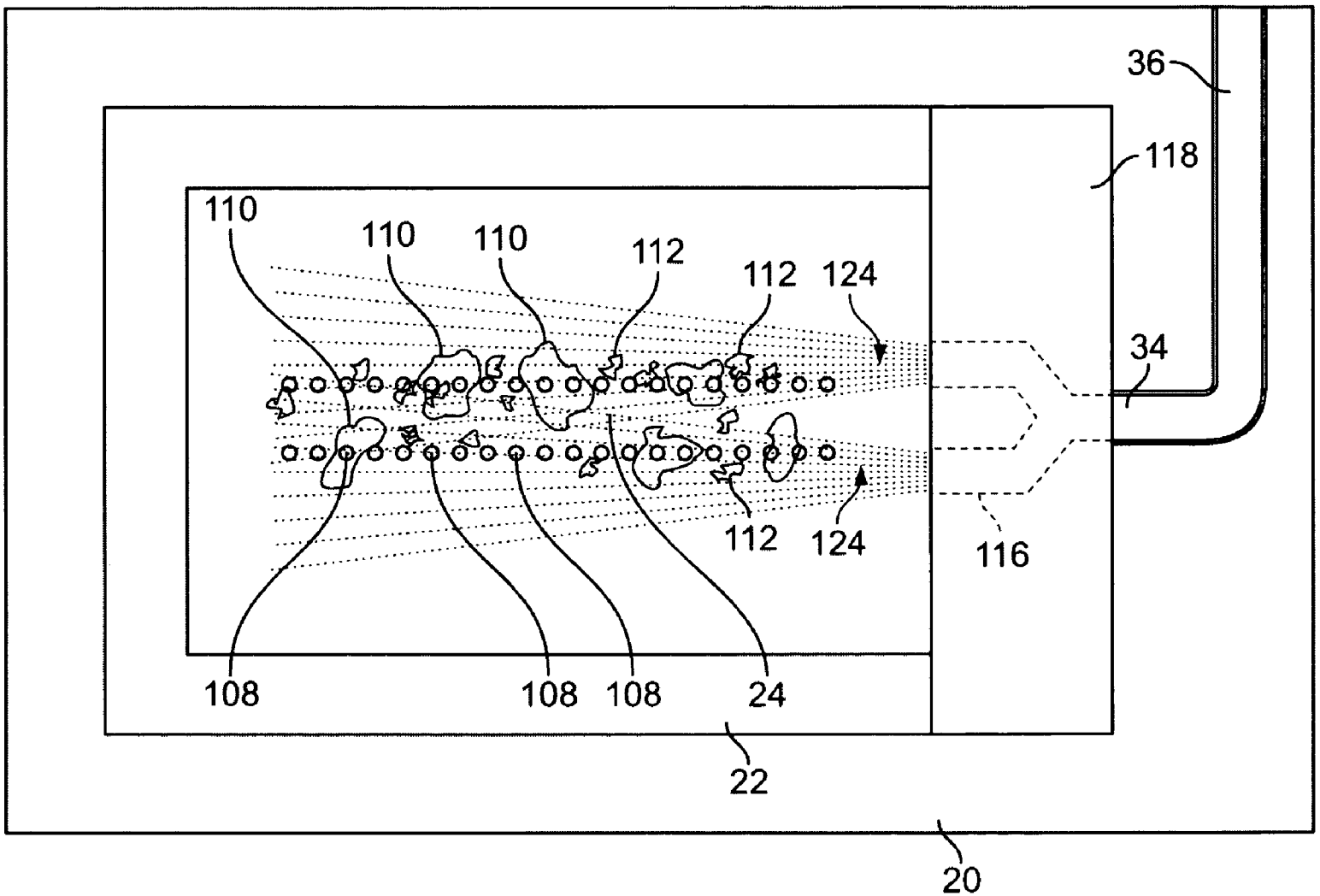
FIG. 7 is a front view of the inkjet printhead, schematically showing a diverter plate having a Y-shaped channel therethrough for guiding a stream of pressurized fluid.
Figure 8:
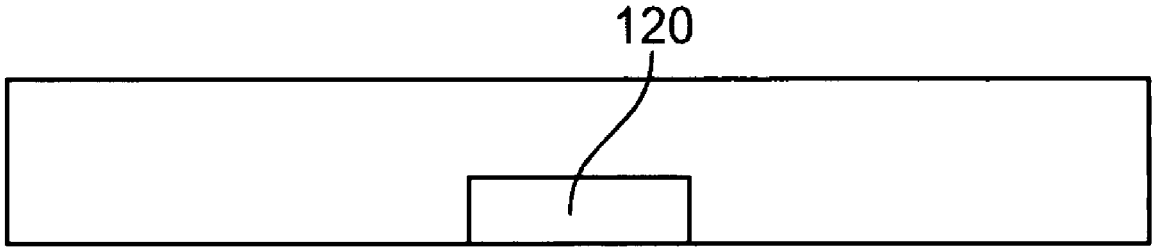
FIG. 8 is a view of an inlet of the Y-shaped channel.
Figure 9:
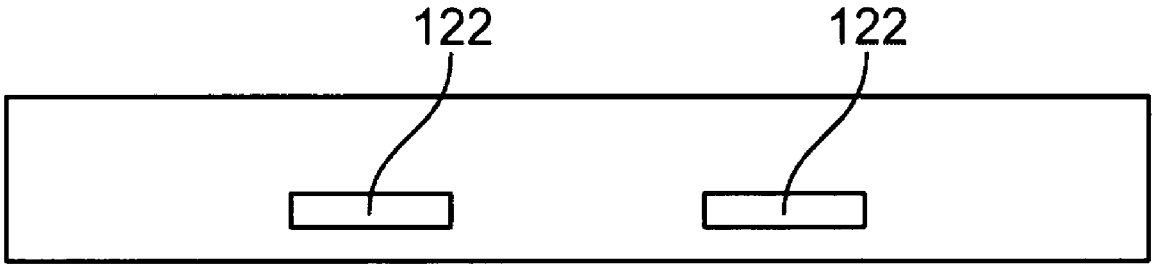
FIG. 9 is a view of outlets of the Y-shaped channel.

In yet another embodiment of the invention, the second pressurized fluid exiting the fluid nozzle 34 passes through a Y-shaped sealed channel 116 in a diverter plate 118, as schematically depicted in FIG. 7. The collection plate 22 in this embodiment has three sides instead of four, with the diverter plate 118 disposed as a fourth side. Referring to FIGS. 8 and 9, the second pressurized fluid enters the Y-shaped channel 116 at an inlet 120 at the base of the Y, and exits the channel 116 at outlets 122 at the top of the Y. The Y-shaped channel 116 effectively splits the stream 114 into two streams 124 that exit the outlets 122 in a path substantially parallel with the surface of the inkjet nozzle array 24. Each of the streams 124 of the second pressurized fluid expands and washes across the surface of the inkjet nozzle array 24. Dried ink 110 and debris 112 are loosened by the force and possibly the chemical composition of the streams 124, and the loosened ink 110 and debris 112 are then entrained by the streams 124 and removed from the surface of the inkjet nozzle array 24.

In still another embodiment of the invention, the printhead mount 72 is flushed with cleaning fluid to clean out residual ink left inside after removal of a printhead cartridge 74. As described above, the first and second sources of ink 44 and 50 may be supplemented by any number of additional sources of ink, each of a unique color. Color contamination caused by residual ink of a given color could have a negative effect on print quality in a subsequent switch to a different color. Cleaning out residual ink by flushing prevents such color contamination. Subsequently, residual cleaning fluid can be blown out of the system using pressurized air.

Removal of a printhead cartridge 74 blocks the second outlet opening 94 of the valve cavity 82. The controller 70 closes the third solenoid valve 48 thereby cutting off the first source of ink 44. Normally closed outlet solenoid valve 68 is opened by the controller 70. The controller 70 opens the fifth solenoid valve 60 allowing cleaning fluid to flow to the ink inlet port 40. The cleaning fluid passes through the printhead mount 72 entering at the ink inlet port 40 and exiting at the ink outlet port 42. The cleaning fluid and any entrained ink then pass through the seventh fluid connector 64 and flow into a waste collection system 66.

After the cleaning fluid flushing operation is completed, the controller 70 closes the fifth solenoid valve 60 and may open a solenoid valve corresponding to a source of pressurized air. Pressurized air may be applied to the ink inlet port 40 to flush out residual cleaning fluid. Next, the controller 70 closes the solenoid valve corresponding to a source of pressurized air and the outlet solenoid valve 68, and opens the fourth solenoid valve 54 allowing ink to flow from the second source of ink 50 to the ink inlet port 40. Alternately, one of the additional sources of ink may be allowed to flow to the inlet port 40 by having the controller 70 open a solenoid valve corresponding to that one additional source of ink.

INDUSTRIAL APPLICABILITY

A cleaning apparatus and method according to the present invention may be used to clean inkjet printhead surfaces of inkjet printing systems, thereby ensuring efficient and high quality production of large volumes of documents. According to one embodiment, ink is forcibly ejected by increased internal pressure within an inkjet printhead, and a stream of a pressurized fluid is guided over the printhead surface to direct ejected ink and debris from the surface onto a collection plate. According to another embodiment, environmental conditions such as temperature and humidity at the surface of the inkjet printhead, as well as temperature, humidity, and gas density in a region of space proximate to the printhead surface can be controlled by selective use of the second pressurized fluid guided by a fluid nozzle. According to yet another embodiment, cleaning fluid is forced through an inkjet printhead to flush out residual ink remaining from a first source of ink, the cleaning fluid and any entrained ink are collected in a waste collection system, residual cleaning fluid is blown out of the inkjet printhead by pressurized air, and a second source of ink is connected to the inkjet printhead.

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications which come within the scope of the appended claims are reserved.

The invention claimed is:

1. A cleaning system for an inkjet printhead comprising:

an inkjet printhead having an inkjet nozzle array and an ink cavity associated therewith;

an expandable bladder disposed within the ink cavity, the expandable bladder in fluid communication with a first source of a first pressurized fluid;

a fluid nozzle associated with the inkjet printhead in fluid communication with a second source of a second pressurized fluid; and a collection plate; a controller for controlling the release of pressurized fluid;

wherein ink is forcibly ejected from the inkjet printhead by expansion of the expandable bladder by the first source of the first pressurized fluid, and a stream of the second pressurized fluid is guided by the fluid nozzle across a surface of the inkjet printhead to direct ink ejected from the inkjet printhead onto the collection plate.

2. The cleaning system of claim 1, wherein the collection plate is made of a porous material.

3. The cleaning system of claim 2, wherein the porous material is plastic.

4. The cleaning system of claim 2, wherein the porous material is metal.

5. The cleaning system of claim 2, wherein the porous material is ceramic.

6. The cleaning system of claim 1, further comprising a controller for wherein the controller controls the timing of when ink is forcibly ejected from the inkjet printhead and when the stream of the second pressurized fluid is guided across the surface of the inkjet printhead.

7. The cleaning system of claim 6, wherein ink is forcibly ejected from the inkjet printhead and the stream of the second pressurized fluid is guided across the surface of the inkjet printhead in synchronism.

8. The cleaning system of claim 7, wherein ink is forcibly ejected from the inkjet printhead and the stream of the second pressurized fluid is guided across the surface of the inkjet printhead simultaneously.

9. The cleaning system of claim 1, wherein debris collected near the inkjet printhead surface is removed therefrom by entrainment in a stream of forcibly ejected ink and the stream of the second pressurized fluid.

10. The cleaning system of claim 1, wherein the first source of the first pressurized fluid is connected to a port on the inkjet printhead by a fluid connector.

11. The cleaning system of claim 1, wherein the first and second sources of the first and second pressurized fluids are the same.

12. The cleaning system of claim 1, wherein the first pressurized fluid is air.

13. The cleaning system of claim 1, wherein the first pressurized fluid is water.

14. The cleaning system of claim 1, wherein the second pressurized fluid is air.

15. The cleaning system of claim 1, wherein the second pressurized fluid is water.

16. The cleaning system of claim 1, wherein the second pressurized fluid is a combination of air and water.

17. The cleaning system of claim 1, wherein the second pressurized fluid is a combination of air, water, and humectant.

18. The cleaning system of claim 1, wherein the second pressurized fluid is a combination of air, water, and solvent.

19. The cleaning system of claim 1, wherein the second pressurized fluid is a combination of air, water, humectant, and solvent.

20. The cleaning system of claim 1, wherein the second pressurized fluid is a combination of air and a water displacing agent.

21. The cleaning system of claim 1, wherein the second pressurized fluid is a combination of air, water displacing agent, and humectant.

22. The cleaning system of claim 1, wherein the second pressurized fluid is a combination of air, water displacing agent, and solvent.

23. The cleaning system of claim 1, wherein the second pressurized fluid is a combination of air, a water displacing agent, humectant, and solvent.

24. The cleaning system of claim 6, wherein the controller initiates forcibly ejecting ink from the inkjet printhead and guiding the stream of the second pressurized fluid across the surface of the inkjet printhead during a period when the inkjet printhead is not actively printing.

25. The cleaning system of claim 2, wherein the fluid nozzle is disposed in a channel through a side of the collection plate.

26. The cleaning system of claim 2, wherein the stream of the second pressurized fluid is split into two streams of the second pressurized fluid.

27. The cleaning system of claim 26, wherein the stream of the second pressurized fluid is split into two streams of the second pressurized fluid by a sealed Y-shaped channel disposed through a diverter plate.

28. A method for cleaning an inkjet printhead comprising the steps of:

providing an expandable bladder disposed within an ink cavity of the inkjet printhead; a controller for controlling the release of pressurized fluid;

applying a first pressurized fluid to expand the expandable bladder to increase the pressure of ink within the ink cavity to forcibly eject ink from the inkjet printhead through an inkjet nozzle array associated therewith;

guiding a stream of a second pressurized fluid across a surface of the inkjet printhead to direct ink ejected from the inkjet printhead onto a collection plate; and collecting the ink ejected from the inkjet printhead on the collection plate.

29. The method for cleaning an inkjet printhead of claim 28, wherein the collection plate is made of a porous material.

30. The method for cleaning an inkjet printhead of claim 29, wherein the porous material is plastic.

31. The method for cleaning an inkjet printhead of claim 29, wherein the porous material is metal.

32. The method for cleaning an inkjet printhead of claim 29, wherein the porous material is ceramic.

33. The method for cleaning an inkjet printhead of claim 28, further wherein the controller controls the timing of when ink is forcibly ejected from the inkjet printhead and when the stream of the second pressurized fluid is guided across the surface of the inkjet printhead.

34. The method for cleaning an inkjet printhead of claim 33, wherein ink is forcibly ejected from the inkjet printhead and the stream of the second pressurized fluid is guided across the surface of the inkjet printhead in synchronism.

35. The method for cleaning an inkjet printhead of claim 34, forcibly ejecting ink from the inkjet printhead and guiding the stream of the second pressurized fluid across the surface of the inkjet printhead simultaneously.

36. The method for cleaning of an inkjet printhead of claim 28, further comprising the step of removing debris collected near a nozzle surface by entrainment in a stream of forcibly ejected ink and the stream of the second pressurized fluid.

37. The method for cleaning an inkjet printhead of claim 33, wherein the controller initiates forcibly ejecting ink from the inkjet printhead and guiding the stream of the second pressurized fluid across the surface of the inkjet printhead during a period when the inkjet printhead is not actively printing.

38. The method for cleaning an inkjet printhead of claim 28, wherein the first pressurized fluid is air.

39. The method for cleaning an inkjet printhead of claim 28, wherein the first pressurized fluid is water.

40. The method for cleaning an inkjet printhead of claim 28, wherein the second pressurized fluid is air.

41. The method for cleaning an inkjet printhead of claim 28, wherein the second pressurized fluid is water.

42. The method for cleaning an inkjet printhead of claim 28, wherein the second pressurized fluid is a combination of air and water.

43. The method for cleaning an inkjet printhead of claim 28, wherein the second pressurized fluid is a combination of air, water, and humectant.

44. The method for cleaning an inkjet printhead of claim 28, wherein the second pressurized fluid is a combination of air, water, and solvent.

45. The method for cleaning an inkjet printhead of claim 28, wherein the second pressurized fluid is a combination of air, water, humectant, and solvent.

46. The method for cleaning an inkjet printhead of claim 28, wherein the second pressurized fluid is a combination of air and a water displacing agent.

47. The method for cleaning an inkjet printhead of claim 28, wherein the second pressurized fluid is a combination of air, water displacing agent, and humectant.

48. The method for cleaning an inkjet printhead of claim 28, wherein the second pressurized fluid is a combination of air, water displacing agent, and solvent.

49. The method for cleaning an inkjet printhead of claim 28, wherein the second pressurized fluid is a combination of air, a water displacing agent, humectant, and solvent.

50. The method for cleaning an inkjet printhead of claim 29, further comprising the step of guiding a second stream of the second pressurized fluid across the surface of the inkjet printhead to direct ink ejected from the inkjet printhead onto the collection plate.

51. A cleaning system for an inkjet printhead comprising:

an inkjet printhead having a port, an ink cavity, and an inkjet nozzle array associated therewith;

a first source of a first pressurized fluid connected to the port by a fluid connector;

an expandable bladder disposed within the ink cavity, the expandable bladder in fluid communication with the first source of the first pressurized fluid via the port;

a fluid nozzle associated with the inkjet printhead in fluid communication with a second source of a second pressurized fluid;

a porous collection plate; and a controller;

wherein ink is forcibly ejected from the inkjet printhead by expansion of the expandable bladder by the first source of the first pressurized fluid, a stream of the second pressurized fluid is guided by the fluid nozzle across a surface of the inkjet printhead to direct ink ejected from the inkjet printhead onto the collection plate, and debris collected near a nozzle surface is removed by entrainment in a stream of forcibly ejected ink and the stream of the second pressurized fluid; and wherein the controller controls the timing of when ink is forcibly ejected from the inkjet printhead and when the stream of the second pressurized fluid is guided across the surface of the inkjet printhead.

52. The cleaning system of claim 51, wherein the porous collection plate is plastic.

53. The cleaning system of claim 51, wherein the porous collection plate is metal.

54. The cleaning system of claim 51, wherein the porous collection plate is ceramic.

55. The cleaning system of claim 51, wherein ink is forcibly ejected from the inkjet printhead and the stream of the second pressurized fluid is guided across the surface of the inkjet printhead in synchronism.

56. The cleaning system of claim 55, wherein ink is forcibly ejected from the inkjet printhead and the stream of the second pressurized fluid is guided by the fluid nozzle across the surface of the inkjet printhead simultaneously.

57. The cleaning system of claim 51, wherein the first and second sources of pressurized fluid are the same.

58. The cleaning system of claim 51, wherein the first pressurized fluid is air.

59. The cleaning system of claim 51, wherein the first pressurized fluid is water.

60. The cleaning system of claim 51, wherein the second pressurized fluid is air.

61. The cleaning system of claim 51, wherein the second pressurized fluid is water.

62. The cleaning system of claim 51, wherein the second pressurized fluid is a combination of air and water.

63. The cleaning system of claim 51, wherein the second pressurized fluid is a combination of air, water, and humectant.

64. The cleaning system of claim 51, wherein the second pressurized fluid is a combination of air, water, and solvent.

65. The cleaning system of claim 51, wherein the second pressurized fluid is a combination of air, water, humectant, and solvent.

66. The cleaning system of claim 51, wherein the second pressurized fluid is a combination of air and a water displacing agent.

67. The cleaning system of claim 51, wherein the second pressurized fluid is a combination of air, water displacing agent, and humectant.

68. The cleaning system of claim 51, wherein the second pressurized fluid is a combination of air, water displacing agent, and solvent.

69. The cleaning system of claim 51, wherein the second pressurized fluid is a combination of air, a water displacing agent, humectant, and solvent.

70. The cleaning system of claim 51, wherein the controller initiates forcibly ejecting ink from the inkjet printhead and guiding the stream of the second pressurized fluid across the surface of the inkjet printhead during a period when the inkjet printhead is not actively printing.

71. The cleaning system of claim 51, wherein the fluid nozzle is disposed in a channel through a side of the collection plate.

72. The cleaning system of claim 51, wherein the stream of the second pressurized fluid is split into two streams of the second pressurized fluid.

73. The cleaning system of claim 72, wherein the stream of the second pressurized fluid is split into two streams of the second pressurized fluid by a sealed Y-shaped channel disposed through a diverter plate.

* * * * *